US010006202B2

(12) United States Patent
Kimura et al.

(10) Patent No.: US 10,006,202 B2
(45) Date of Patent: Jun. 26, 2018

(54) BUCKLING-RESTRAINED BRACE AND METHOD OF MANUFACTURING BUCKLING-RESTRAINED BRACE

(71) Applicant: NIPPON STEEL & SUMIKIN ENGINEERING CO., LTD., Tokyo (JP)

(72) Inventors: Isao Kimura, Tokyo (JP); Norihisa Kawamura, Tokyo (JP); Toyoki Kuroiwa, Tokyo (JP)

(73) Assignee: NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 25 days.

(21) Appl. No.: 15/030,518

(22) PCT Filed: Aug. 31, 2015

(86) PCT No.: PCT/JP2015/074681
§ 371 (c)(1),
(2) Date: Apr. 19, 2016

(87) PCT Pub. No.: WO2017/037833
PCT Pub. Date: Mar. 9, 2017

(65) Prior Publication Data

US 2017/0234012 A1 Aug. 17, 2017

(51) Int. Cl.
*E04C 3/293* (2006.01)
*E04B 1/18* (2006.01)
(Continued)

(52) U.S. Cl.
CPC ..... *E04C 3/293* (2013.01); *E04B 1/18* (2013.01); *E04B 1/98* (2013.01); *E04H 9/021* (2013.01); *E04B 2103/06* (2013.01)

(58) Field of Classification Search
CPC ... E04H 9/021; E04B 1/18; E04B 1/98; E04C 3/293
(Continued)

(56) References Cited

U.S. PATENT DOCUMENTS 7,185,462 B1 * 3/2007 Smelser ..... E04H 9/02 52/167.1
8,763,320 B1 * 7/2014 Chou ..... E04B 1/98 52/167.3
(Continued)

FOREIGN PATENT DOCUMENTS

JP 11-50594 A 2/1999
JP 2005-42537 A 2/2005
(Continued)

OTHER PUBLICATIONS

International Search Report for PCT/JP2015/074681 dated Sep. 29, 2015.
(Continued)

*Primary Examiner* — Paola Agudelo
(74) *Attorney, Agent, or Firm* — Birch, Stewart, Kolasch & Birch, LLP

(57) ABSTRACT

The buckling-restrained brace that is capable of being fixed to connected portions of a structure using bolts, the brace includes: a plate member extending in an axial direction, and in which bolt holes for fixing the bolts are formed at end portions of the plate member in the axial direction; and a buckling-restrained member configured to restrain a center portion of the plate member in the axial direction to prevent the plate member from buckling, wherein the buckling-restrained member includes a pipe member surrounding the plate member from the outside in a radial direction, and a filler filling the gap between the pipe member and the plate member, and the plate member includes a fixing plate, a portion of which is embedded in the filler, and the remaining
(Continued)

portion is protruded from the filler in the axial direction, and in which the bolt hole is formed at an end portion of the remaining portion in the axial direction.

3 Claims, 8 Drawing Sheets

(51) Int. Cl.
*E04B 1/98* (2006.01)
*E04H 9/02* (2006.01)

(58) Field of Classification Search
USPC ..... 52/167.3
See application file for complete search history.

(56) References Cited

U.S. PATENT DOCUMENTS

| | | | | |
|---|---|---|---|---|
| 9,453,342 | B2 * | 9/2016 | Tsai | E04C 3/06 |
| 9,540,812 | B2 * | 1/2017 | Tsai | E04B 1/98 |
| 2003/0221389 | A1 * | 12/2003 | Smelser | E04C 3/02 52/853 |
| 2005/0005539 | A1 * | 1/2005 | Nakamura | F16F 7/00 52/167.3 |
| 2008/0250732 | A1 * | 10/2008 | Tsai | E04H 9/02 52/167.3 |
| 2013/0139452 | A1 * | 6/2013 | Tsai | E04B 1/98 52/167.3 |
| 2015/0000228 | A1 * | 1/2015 | Dusicka | E04C 3/00 52/835 |
| 2015/0218838 | A1 * | 8/2015 | Ichikawa | E04H 9/00 52/167.3 |
| 2015/0284971 | A1 * | 10/2015 | Ichikawa | E04H 9/02 52/167.3 |

FOREIGN PATENT DOCUMENTS

| | | | |
|---|---|---|---|
| JP | 2007-291704 | A | 11/2007 |
| JP | 2008-75281 | A | 4/2008 |
| JP | 4263664 | B2 | 5/2009 |
| JP | 2010-168865 | A | 8/2010 |
| JP | 2014-31654 | A | 2/2014 |

OTHER PUBLICATIONS

Written Opinion of the International Searching Authority for PCT/JP2015/074681 (PCT/ISA/237) dated Sep. 29, 2015.

* cited by examiner

BUCKLING-RESTRAINED BRACE AND METHOD OF MANUFACTURING BUCKLING-RESTRAINED BRACE

TECHNICAL FIELD

The present invention relates to a buckling-restrained brace, and a method of manufacturing a buckling-restrained brace.

BACKGROUND ART

In the related art, a method in which a buckling-restrained brace is fixed to a gusset plate (connected portion) of a structure and absorbs vibration energy when the structure vibrates by the impact of an earthquake, wind, or the like, has been evaluated.

For example, a buckling-restrained brace disclosed in patent document 1 as mentioned below includes an axial-force member (plate member) showing resistance against tensile force or compressive force applied in an axial direction, and a restrained member (buckling-restrained member) that is provided on the circumference of the axial-force member and restrains the buckling of the axial-force member. A bond-preventing film is provided in the gap between the axial-force member and the restrained member so as to prevent bonding therebetween. The axial-force member includes a plastic portion, the circumference of which is covered with the restrained member; a reinforcement portion that reinforces the rigidity of a portion of the axial-force member protruding from the restrained member; and a joint that is provided on the outside of the reinforcement portion and is joined to the structure.

The restrained member includes a reinforcement steel pipe (pipe member) that is provided on the circumference of the axial-force member, and concrete (filler) which fills the gap between the steel pipe and the axial-force member and which is hardened. Since the bond-preventing film is applied to the surface of the axial-force member, bonding between the axial-force member and hardened concrete or hardened mortar is prevented.

The buckling-restrained brace with such a configuration is fixed to a gusset plate using a pair of two splice plates. More specifically, the gusset plate is interposed between end portions of the two splice plates disposed facing each other, and the splice plates and the gusset plate are fixed together using bolts. The joint is interposed between the other end portions of the two splice plates, and the splice plates and the joint are fixed together using bolts.

When vibration energy is applied to the structure with such a configuration due to an earthquake, wind, or the like, tensile force or compressive force is applied to the buckling-restrained brace in the axial direction. The plastic portion of the axial-force member receives this force, is elastically deformed, and is further deformed plastically. As a result, the buckling-restrained brace absorbs the vibration energy.

CITATION LIST

Patent Document

Patent Document 1: Japanese Patent Publication No. 4263664

SUMMARY OF INVENTION

Technical Problem

However, in the buckling-restrained brace disclosed in patent document 1, the gusset plate and the joint are respectively fixed to both end portions of the splice plates, and thus the length of the steel pipe, which is disposed between a pair of the gusset plates attached to the structure, is decreased. Since the rigidity of the axial-force member is increased by the steel pipe and the concrete which fills the inside of the steel pipe, when the length of the axial-force member (plate member) is decreased, the rigidity of the entire buckling-restrained brace is decreased.

The gusset plates and the buckling-restrained brace may be fixed together by welding instead of bolts. However, in the fixing method using welding, high skill is required to fix the buckling-restrained brace, and it becomes difficult to fix the buckling-restrained brace.

The present invention is made in light of this problem, and an object of the present invention is to provide a buckling-restrained brace, the rigidity of which can be increased, and which can be easily fixed to a connected portion of a structure.

Solution to Problem

The invention proposes the following means to solve this problem.

According to a first aspect of the present invention, a buckling-restrained brace that is capable of being fixed to connected portions of a structure using bolts is provided, the brace includes: a plate member extending in an axial direction, and in which bolt holes for fixing the bolts are formed at end portions of the plate member in the axial direction; and a buckling-restrained member configured to restrain a center portion of the plate member in the axial direction to prevent the plate member from buckling, wherein the buckling-restrained member includes a pipe member surrounding the plate member from the outside in a radial direction, and a filler filling the gap between the pipe member and the plate member, and the plate member includes a fixing plate, a portion of which is embedded in the filler, and the remaining portion is protruded from the filler in the axial direction, and in which the bolt hole is formed at an end portion of the remaining portion in the axial direction.

According to a second aspect of the present invention, a method of manufacturing a buckling-restrained brace is provided, the method including: a first step in which a plate member including a fixing plate extending in an axial direction of the plate member is inserted to a pipe member so that the pipe member is surrounding the plate member and an end portion of the fixing plate in the axial direction is protruded from the pipe member in the axial direction; and a second step in which the gap between the pipe member and the plate member is filled with a filler, and thereby restraining a center portion of the plate member in the axial direction to prevent the plate member from buckling, wherein a portion of the fixing plate is embedded in the filler, the remaining portion of the fixing plate is protruded from the filler in the axial direction, and a bolt hole is formed at an end portion of the remaining portion protruding from the pipe member in the axial direction and is used to fix the buckling-restrained brace to a connected portion of a structure using a bolt.

According to these aspects, the end portion of the fixing plate in the axial direction is directly fixed to the connected portion of the structure, and thus it is possible to extend the pipe member so as to reach the end portion of the plate member in the axial direction.

In the buckling-restrained brace, a pair of the fixing plates may be disposed in the end portion of the plate member in the axial direction so as to be placed side by side with each other in a thickness direction of the fixing plate. Also, the connected portion may be interposed between the fixing plates in the thickness direction.

In the buckling-restrained brace, the plate member may include a core plate that is fixed to the pair of fixing plates while being interposed between the fixing plates.

According to this aspect, the connected portion and the core plate are interposed between the pair of fixing plates, and thus the connected portion and the core plate are disposed in the same plane.

In the buckling-restrained brace, the core plate may protrude further than the pair of fixing plates in an intersection direction intersecting the axial direction and the thickness direction. Also, a portion of the core plate protruding in the intersection direction may be fixed to an edge portion of each of the pair of fixing plates in the intersection direction via a welding portion.

In the first step of the method of manufacturing a buckling-restrained brace, the plate member may be prepared by fixing the fixing plate and a core plate together via a welding portion, and the plate member may be surrounded by the pipe member so that the welding portion is disposed on the inside of the pipe member.

Note that, the welding portion includes weld metal used for welding, and a heat-affected zone, the composition of which is changed due to heat during welding.

In the buckling-restrained brace, the fixing plate may be equivalent for the total length to the plate member. Also, the bolt holes may be respectively formed in the end portions of the fixing plate in the axial direction.

In the buckling-restrained brace, the fixing plate may be arranged at each end portion of the plate member in the axial direction. Also, the plate member may include a core plate in which the fixing plate is fixed to each end portion of the core plate.

Advantageous Effects of Invention

In these aspects, according to the buckling-restrained brace and the method of manufacturing the buckling-restrained brace of the present invention, it is possible to increase the length of the pipe member compared to conventional before, and thus it is possible to increase the rigidity of the buckling-restrained brace. Since it is possible to fix the buckling-restrained brace to the connected portion of the structure by fastening the bolt into the bolt hole unlike the related art in which the buckling-restrained brace is fixed to the connected portion of the structure via a splice plate, it is possible to easily fix the buckling-restrained brace to the connected portion of the structure.

According to the buckling-restrained brace of the present invention, the connected portion is fixed to the pair of fixing plates while being interposed therebetween, and thus it is possible to reliably fix the plate member to the connected portion.

According to the buckling-restrained brace of the present invention, external force applied to the buckling-restrained brace through the connected portion can be effectively transmitted to the core plate as tensile force and compressive force in the axial direction.

According to the buckling-restrained brace, and the method of manufacturing a buckling-restrained brace of the present invention, the core plate and the pair of fixing plates are easily fixed together by the welding portion.

According to the buckling-restrained brace of the present invention, since the fixing plates are integrally formed in the axial direction, even though the fixing plates are provided on both end portions of the buckling-restrained brace in the axial direction, it is possible to reduce the number of fixing plates used.

According to the buckling-restrained brace of the present invention, the fixing plate to be fixed to the connected portion is disposed in each end portion in the axial direction, and thus it is easy to fix the fixing plate to the connected portion:

DESCRIPTION OF EMBODIMENTS

First Embodiment

Hereinafter, a buckling-restrained brace in a first embodiment of the present invention will be described with reference to FIGS. 1 to 9.

Figure 1:
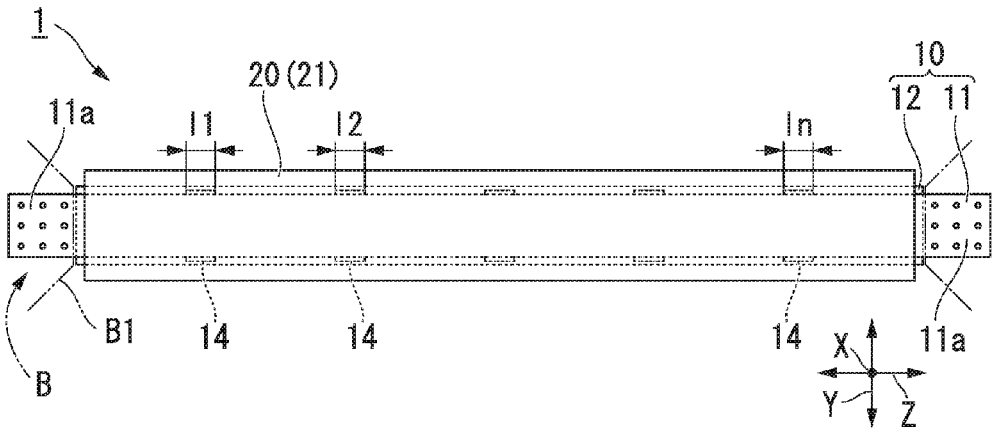
FIG. 1 is a side view of a buckling-restrained brace in a first embodiment of the present invention.
Figure 4:
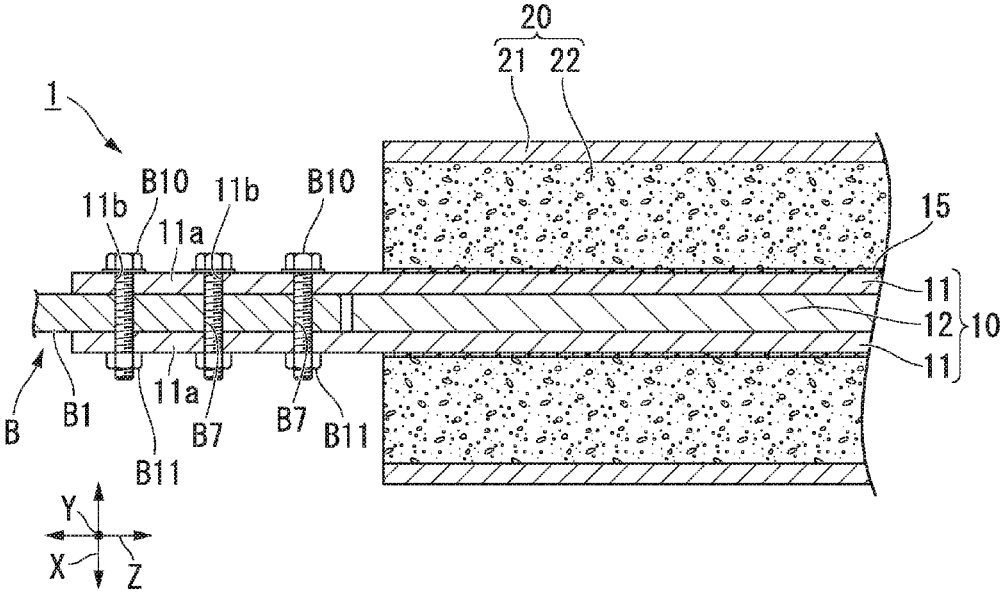
FIG. 4 is a top sectional view of the main part in FIG. 1.

As illustrated in FIG. 1, a buckling-restrained brace 1 in the embodiment is fixed to a gusset plate (connected portion) B1 of a structure B such as a building using bolts B10 (refer to FIG. 4).

Figure 2:
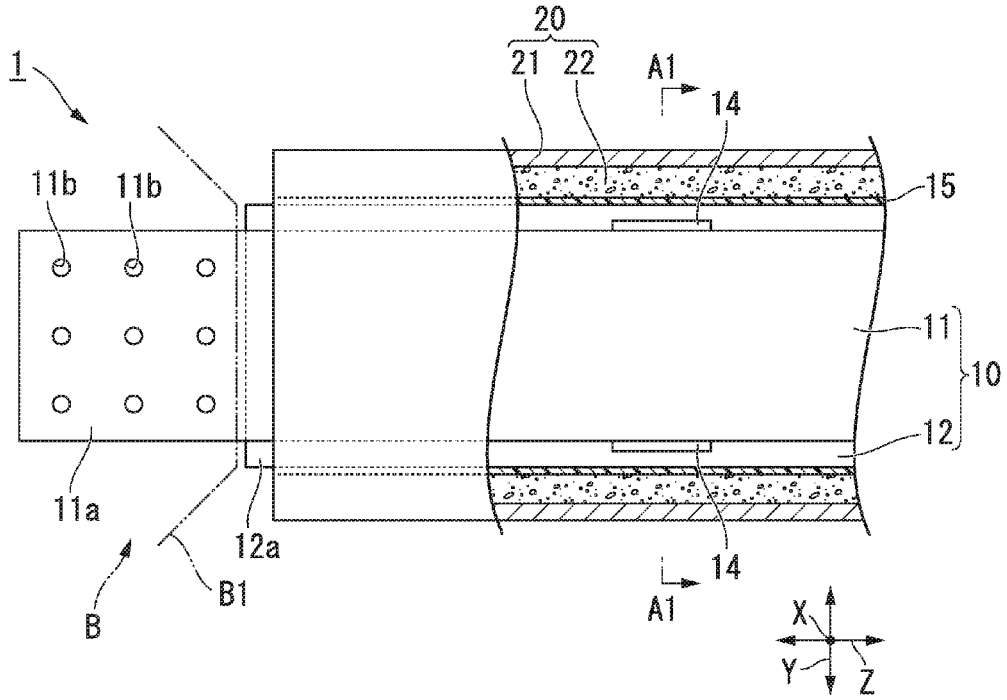
FIG. 2 is a view illustrating a state in which a portion of a main part in FIG. 1 is cut out.
Figure 3:
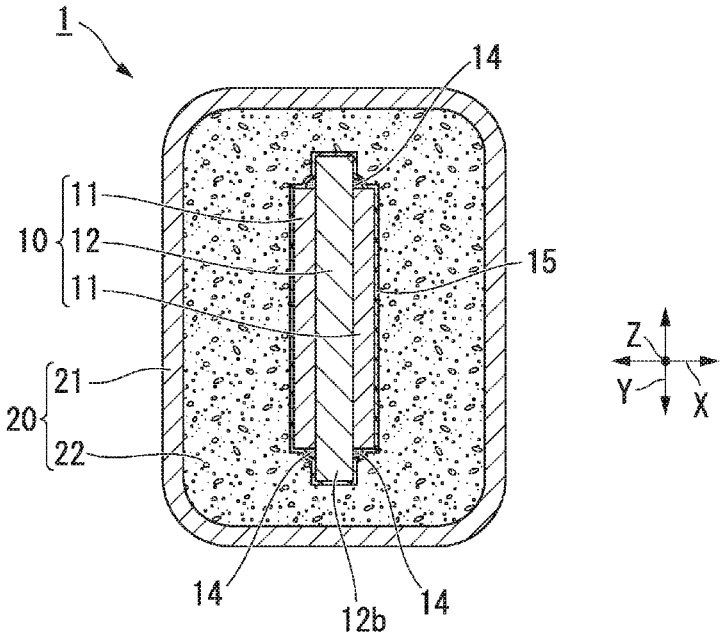
FIG. 3 is a sectional view of the main part taken along cutting-plane line A1-A1 in FIG. 2.

As illustrated in FIGS. 2 to 4, the buckling-restrained brace 1 includes a plate member 10 extending in an axial direction Z, and in which bolt holes 11*b* for fixing the bolts B10 are formed in each end portion thereof in the axial direction Z, and a buckling-restrained member 20 configured to restrain a center portion of the plate member 10 in the axial direction Z to prevent the plate member from buckling. The gusset plate B1, the bolts B10, and the like are illustrated by the solid line in FIG. 4, and the gusset plate B1 is illustrated by the two-dot chain line in FIGS. 1 and 2.

The buckling-restrained member 20 includes a pipe member 21 surrounding (covering) the plate member 10 from the outside in a radial direction of the plate member 10, and a filler 22 filling the gap between the pipe member 21 and the plate member 10.

In this embodiment, the pipe member 21 made of a steel material or the like is formed to have a rectangular cylinder shape. However, the shape of the pipe member 21 is not limited to the rectangular cylinder shape, and the pipe member 21 may be formed to have a circular cylinder shape. Also, the filler 22 is formed of mortar. However, the filler 22 may be formed of concrete. The entire length of the pipe member 21 is filled with the filler 22.

The plate member 10 includes a pair of fixing plates 11 disposed in the end portion of the plate member 10 in the axial direction so as to be placed side by side with each other in a thickness direction of the fixing plates 11, and a core plate 12 fixed to the pair of fixing plates 11 while being interposed between the pair of fixing plates 11.

The length of the core plate 12 in the axial direction Z is greater than the length of the pipe member 21 in the axial direction Z. Each of end portions 12*a* of the core plate 12 in the axial direction Z protrudes from the pipe member 21 in the axial direction Z.

In the embodiment, the length of the core plate 12 in a perpendicular direction (width direction) Y perpendicular to the axial direction Z and the thickness direction X is constant at any position of the core plate 12 in the axial direction Z.

The length of the fixing plate 11 in the axial direction Z is greater than the length of the core plate 12 in the axial direction Z. The fixing plates 11 extend over the entire length of the plate member 10. Each of end portions 11*a* of the fixing plate 11 in the axial direction Z protrudes further than the core plate 12 and the pipe member 21. Multiple bolt holes 11*b* are formed in each of the end portions 11*a* of the fixing plate 11.

A portion of each of the fixing plates 11 is embedded in the filler 22, and the remaining portion is protruded from the filler 22 in the axial direction Z. The fixing plates 11 form the end portion of the plate member 10 in the axial direction Z. The pair of fixing plates 11 has the same shape.

The core plate 12 protrudes further than the pair of fixing plates 11 in the perpendicular direction Y. That is, the length of each of the fixing plates 11 in the perpendicular direction Y is greater than the length of the core plate 12 in the perpendicular direction Y. In the embodiment, the length of the fixing plate 11 in the perpendicular direction Y is constant at any position in the axial direction Z.

The fixing plates 11 and the core plate 12 are made of a steel plate or the like.

As illustrated in FIG. 3, a portion 12*b* (which protrudes further than the fixing plates 11 in the perpendicular direction Y) of the core plate 12 and end portions of the pair of fixing plates 11 in the perpendicular direction Y are fixed by welding portions 14.

In the embodiment, as illustrated in FIG. 1, the welding portions 14 are intermittently formed at n locations in such a way as to line up in the axial direction Z. n is a natural number greater than or equal to two, and in this example, n is five. As illustrated in FIG. 3, the welding portions 14 are formed at a total of four locations at a position in which each of the welding portions 14 is formed in the axial direction Z. The four locations include locations which are symmetrical to each other with the core plate 12 interposed between the locations, and locations which are symmetrical to each other with the fixing plate 11 interposed with the positions.

That is, the welding portions 14 are formed at a total of (n×4) locations on the buckling-restrained brace 1.

The fixing force of the welding portion 14 between the portion 12*b* of the core plate 12 and the end portion of the fixing plate 11 satisfies Expression (1).

$$4 \times \sum_{i=1}^{n} li \times Fcw \leqq Wc \times tc \times Fyc \tag{1}$$

Note that, li is a welding length (refer to FIG. 1) along the axial direction Z at an i-th position in the axial direction Z. Also, Fcw is weld yield strength, We is the length of a center portion (in the axial direction Z) of the core plate 12 in the perpendicular direction Y, tc is the length of the center portion (in the axial direction Z) of the core plate 12 in the thickness direction X, and Fyc is the yield strength of the center portion of the core plate 12 in the axial direction Z.

4 on the left side of Expression (1) implies that the welding portions 14 are formed at four predetermined positions in the axial direction Z.

When tensile force and compressive force are applied to the pair of fixing plates 11 of the buckling-restrained brace 1, it is possible to allow the pair of fixing plates 11 and the core plate 12 to integrally behave, and to transmit axial force in the axial direction Z between the pair of fixing plates 11 and the core plate 12 by designing the welding portions 14 to satisfy Expression (1).

It is possible to appropriately set n (the number of welding portions 14 formed in the axial direction Z), the weld length li, and the like according to the length of the buckling-restrained brace 1 in the axial direction Z, the axial force applied to the buckling-restrained brace 1, and the like.

The welding portions 14 are embedded in the filler 22, and are disposed on the inside of the pipe member 21.

As illustrated in FIGS. 2 to 4, the pair of fixing plates 11, the core plate 12, and the welding portions 14 are covered with a bond-preventing layer 15. The bond-preventing layer 15 can be formed of a waterproof sheet or the like. The bond-preventing layer 15 prevents bonding between the hardened filler 22 and the plate member 10.

Figure 5:
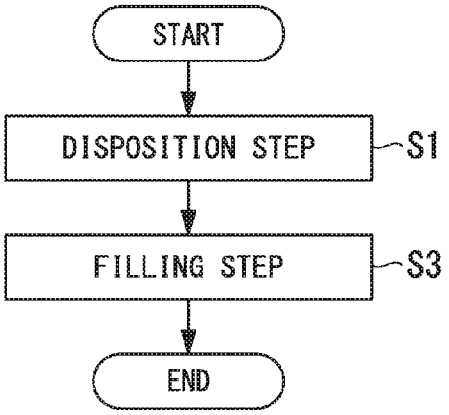
FIG. 5 is a flowchart illustrating a method of manufacturing a buckling-restrained brace in the first embodiment of the present invention.

Hereinafter, a method (hereinafter, also simply referred to as a manufacturing method) of manufacturing the buckling-restrained brace 1 with such a configuration will be described. FIG. 5 is a flowchart illustrating the manufacturing method in the embodiment. The manufacturing method includes a disposition step (first step, S1) in which the plate member 10 is surrounded by the pipe member 21, and a filling step (second step, S3) in which the gap between the pipe member 21 and the plate member 10 is filled with the filler 22.

Figure 6:
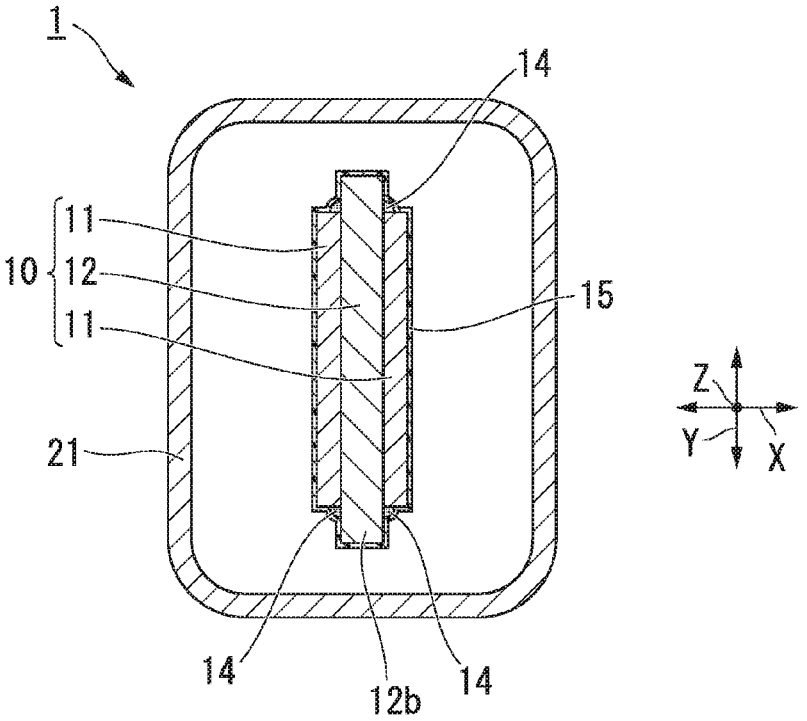
FIG. 6 is a sectional view illustrating a disposition step of the method of manufacturing a buckling-restrained brace.

First, in the disposition step S1, as illustrated in FIG. 6, an operator prepares the plate member 10 by fixing the pair of fixing plates 11 and the core plate 12 together using the welding portions 14. The welding portion 14 can be formed by a well-known welding method such as arc welding. Since the step between the portion 12*b* of the core plate 12 and the end portion of the fixing plate 11 in the perpendicular direction Y is formed suitably for lap fillet welding, it is possible to easily perform welding.

The bond-preventing layer 15 is formed by attaching a sheet to the plate member 10.

The pipe member 21 surrounds the plate member 10 from the outside in the radial direction. That is, the plate member 10 is disposed on the inside of the pipe member 21. The welding portions 14 are disposed on the inside of the pipe member 21. As illustrated in FIG. 2, each of the end portions 11*a* of the fixing plate 11 in the axial direction Z is disposed to protrude outward from the pipe member 21 in the axial direction Z.

The disposition step S1 ends, and the process proceeds to the step S3.

Subsequently, in the filling step S3, the gap between the pipe member 21 and the plate member 10 is filled with the filler 22. More specifically, the gap between the pipe member 21 and the plate member 10 is filled with non-hardened mortar. The mortar is gradually hardened such that the filler 22 is formed. The filler 22 and the pipe member 21 form the buckling-restrained member 20. At this time, since the plate member 10 is covered with the bond-preventing layer 15, the filler 22 and the plate member 10 are not bonded together. Since the plate member 10 is covered with the filler 22 and the pipe member 21, the buckling of the center portion of the plate member 10 in the axial direction Z is restrained.

The filling step S3 ends, and the entire process of the manufacturing method ends.

Figure 7:
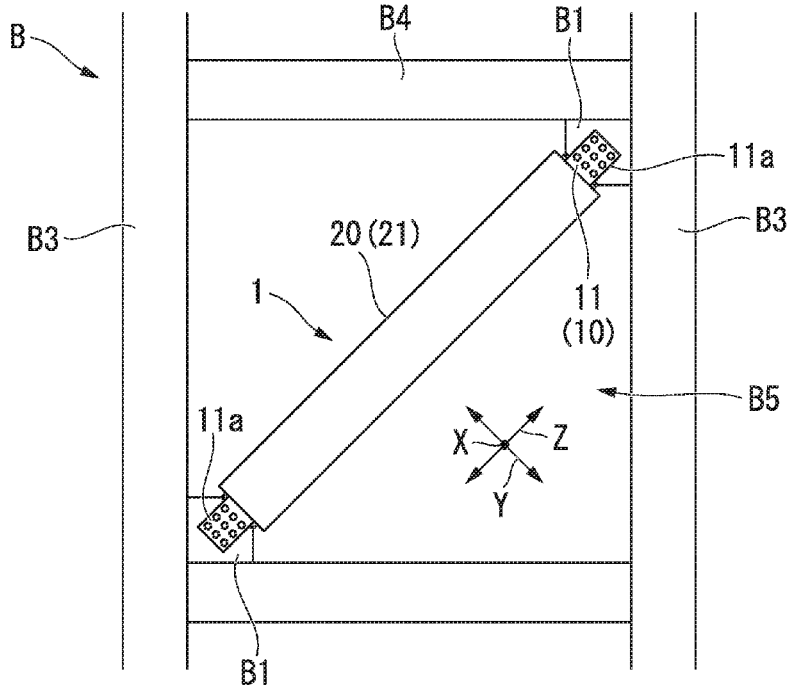
FIG. 7 is a view illustrating a state in which the buckling-restrained brace is fixed to a structure in a single-diagonal configuration.

In the following sequence, the manufactured buckling-restrained brace 1 with such a configuration is fixed to the structure B including pillars B3 and beams B4 as illustrated in FIG. 7. In the structure B, the gusset plate B1 is welded to the joining portion between the pillar B3 and the beam B4. The gusset plate B1 is provided with multiple through-holes B7 (refer to FIG. 4) into which the bolts B10 are inserted.

The buckling-restrained brace 1 is hoisted by a crane or the like, and is disposed between a pair of the gusset plates B1. As illustrated in FIGS. 4 and 7, the gusset plate B1 is interposed between the end portions 11*a* of the buckling-restrained brace 1 in the axial direction Z. The bolts B10 are inserted into the bolt holes 11*b* of the fixing plates 11 and the through-holes B7 of the gusset plate B1, and are screwed into nuts such that the end portions 11*a* and the gusset plate B1 are fixed together. Since the gusset plate B1 is fixed to the pair of fixing plates 11 while being interposed therebetween in the thickness direction X, the plate member 10 is reliably fixed to the gusset plate B1. At this time, as illustrated in FIG. 4, the core plate 12 and the gusset plates B1 are disposed in the same plane T.

The buckling-restrained brace 1 is fixed to the structure B in the aforementioned sequence. The fixing method, by which one buckling-restrained brace 1 for reinforcing the structure B is fixed to the structure B in a state where the one the buckling-restrained brace 1 is disposed in a space B5 formed by a pair of the pillars B3 and a pair of the beams B4 as illustrated in FIG. 7, is referred to as a single-diagonal configuration.

The gusset plate B1 is directly fixed to the fixing plates 11 of the buckling-restrained brace 1 without the intervention of a splice plate or the like. For this reason, it is possible to extend the pipe member 21 to the vicinity of the end portions 11*a* of the buckling-restrained brace 1 in the axial direction Z.

Vibration energy is applied to the structure B in the event of an earthquake, wind, or the like. Axial force, that is, tensile force and compressive force in the axial direction Z, is applied to the buckling-restrained brace 1. The pair of the fixing plates 11 and the core plate 12 of the plate member 10 in the buckling-restrained brace 1 behave integrally. Since the pair of fixing plates 11 and the core plate 12 are elastically deformed, and are further deformed plastically, the vibration energy is absorbed, and vibration of the structure B is suppressed.

Since the buckling-restrained member 20 restrains the buckling of the plate member 10 at this time, the plate member 10 can be stably deformed. Since the core plate 12 and the gusset plates B1 are disposed in the same plane T, the force applied to the buckling-restrained brace 1 through the gusset plates B1 is transmitted to the core plate 12 while the twisting of the force is suppressed.

Figure 8:
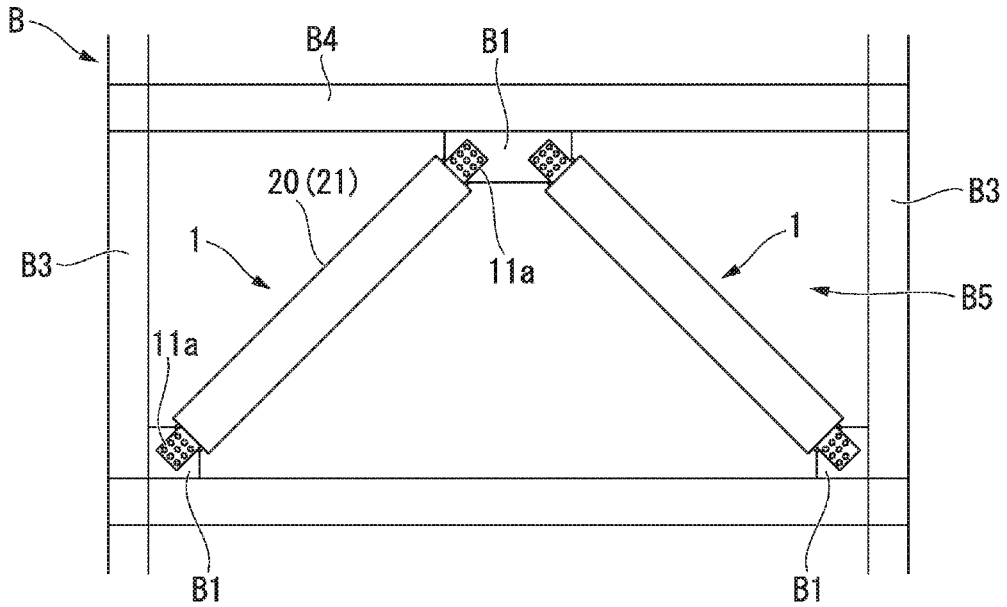
FIG. 8 is a view illustrating a state in which the buckling-restrained brace is fixed to the structure in a chevron configuration.

In the embodiment, as illustrated in FIG. 8, a chevron configuration, in which two buckling-restrained braces 1 are disposed in the space B5 to reinforce the structure B, may be used. In the single-diagonal configuration illustrated in FIG. 7 with regard to the disposition of the buckling-restrained brace 1 in the space B5 with the same shape to reinforce the structure B, the length of the buckling-restrained brace 1 in the axial direction Z is greater than that in the chevron configuration. Since the buckling-restrained member 20 restrains the buckling of the plate member 10 of the buckling-restrained brace 1, even though the length of the buckling-restrained brace 1 in the axial direction Z is large, the buckling-restrained brace 1 is not buckled. Since the buckling-restrained brace 1 is used in the single-diagonal configuration, it is possible to reduce the number of the buckling-restrained braces 1 required to reinforce the structure B.

As described above, according to the buckling-restrained brace 1 and the manufacturing method in the embodiment, the end portions 11*a* of the fixing plates 11 are directly fixed to the gusset plate B1 of the structure B, and thus it is possible to extend the pipe member 21 to the end portions 11*a* of the plate member 10 in the axial direction Z. Since it is possible to increase the length of the pipe member 21 compared to conventional before, and thus it is possible to increase the rigidity of the buckling-restrained brace 1. Since it is possible to fix the buckling-restrained brace 1 to the gusset plates B1 of the structure B by fastening the bolts B10 into the bolt holes 11*b*, it is possible to easily fix the buckling-restrained brace 1 to the gusset plates B1 of the structure B without the intervention of splice plates.

Since the buckling-restrained brace 1 can be directly fixed to the gusset plates B1 of the structure B, it is possible to reduce the number of members and weight of the members required to fix the buckling-restrained brace 1 to the gusset plates B1, and to prevent an increase in the amount of cost required to join the gusset plates B1 and the buckling-restrained brace 1 together.

A plastic portion of an axial center portion of a buckling-restrained brace disclosed in patent document 1 is narrow. In contrast, since the buckling-restrained brace 1 in the embodiment does not include such a narrow portion, it is possible to improve the yield rate of a steel material, and to reduce the number of required processes.

It is possible to simplify the shape of the plate member 10 which is a core member compared to the buckling-restrained brace disclosed in patent document 1.

The buckling-restraining effects of mortar or concrete are not taken into consideration in designing a buckling-restrained brace in the related art. In contrast, the buckling-restrained brace 1 in the embodiment is designed while the restraining effects of a portion (which is disposed on a compression side) of the filler 22 (which is formed of mortar or concrete) are taken into consideration.

The pair of fixing plates 11 is disposed to line up in the thickness direction X, and the gusset plate B1 is interposed between the pair of fixing plates 11. Since the gusset plate B1 is fixed to the pair of fixing plates 11 while being interposed therebetween, it is possible to reliably fix the plate member 10 to the gusset plate B1.

The plate member 10 includes the core plate 12. Since the gusset plates B1 and the core plate 12 are interposed between the pair of fixing plates 11, the gusset plates B1 and the core plate 12 are disposed in the same plane T. Accordingly, external force applied to the buckling-restrained brace 1 along the gusset plates B1 can be effectively transmitted to the core plate 12 as tensile force and compressive force in the axial direction Z.

Since the portions 12*b* (which protrude in the perpendicular direction Y) of the core plate 12 and the end portions of the pair of fixing plates 11 in the perpendicular direction Y are fixed together by the welding portions 14, the core plate 12 and the pair of fixing plates 11 are easily fixed together by the welding portions 14.

Figure 9:
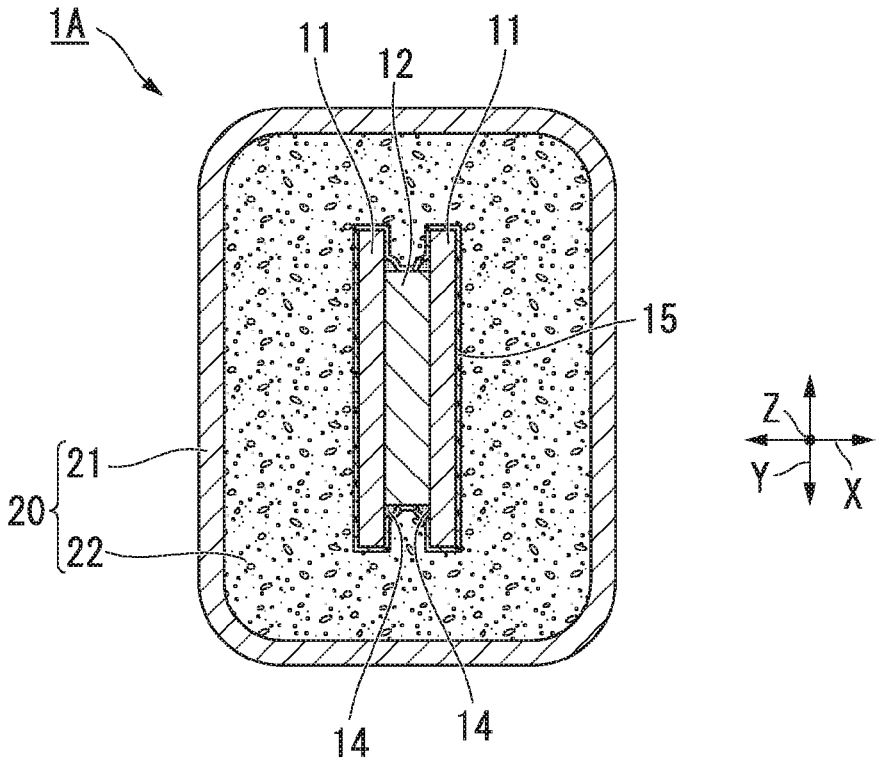
FIG. 9 is a front sectional view of a buckling-restrained brace in an example in which the shape of a core plate in the embodiment of the present invention is modified.

In the embodiment, the core plate 12 may be recessed further than the pair of fixing plates 11 in the perpendicular direction Y as illustrated in a buckling-restrained brace 1A in FIG. 9. Also in the buckling-restrained brace 1A with such a configuration, the step between the end portion of the core plate 12 in the perpendicular direction Y and the end portion of the fixing plate 11 in the perpendicular direction Y is formed suitably for lap fillet welding, and thus it is possible to easily perform welding.

Second Embodiment

Hereinafter, a second embodiment of the present invention will be described with reference to FIGS. 10 and 11. The same reference signs will be assigned to the same portions as in the aforementioned embodiment, and descriptions thereof will be omitted. Only the points of difference will be described.

Figure 10:
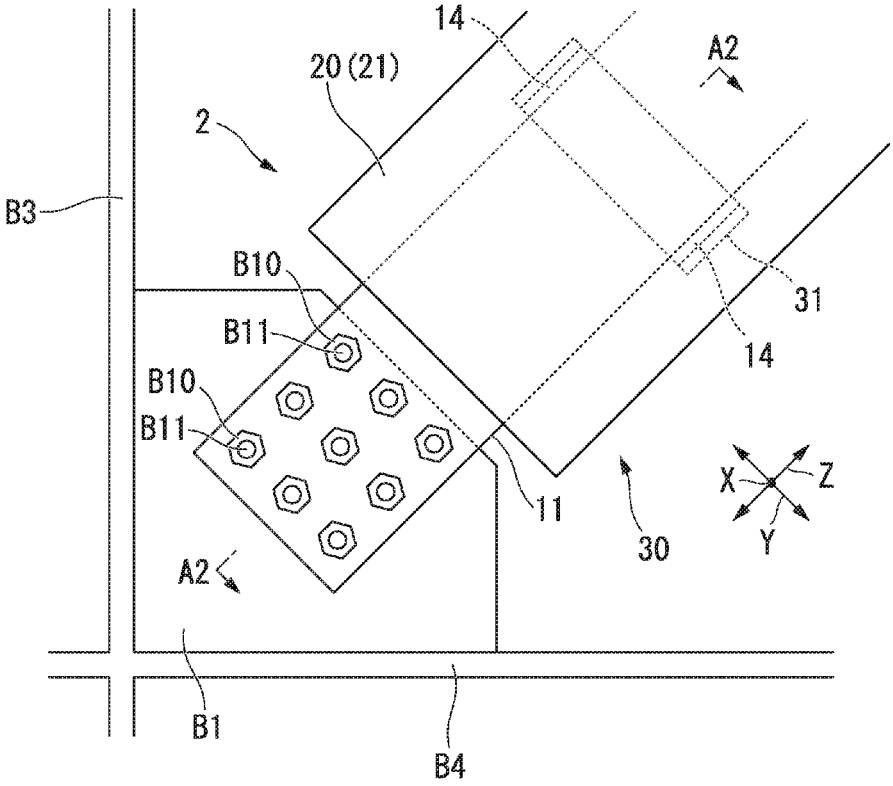
FIG. 10 is a side view of a main part of a buckling-restrained brace in a second embodiment of the present invention.
Figure 11:
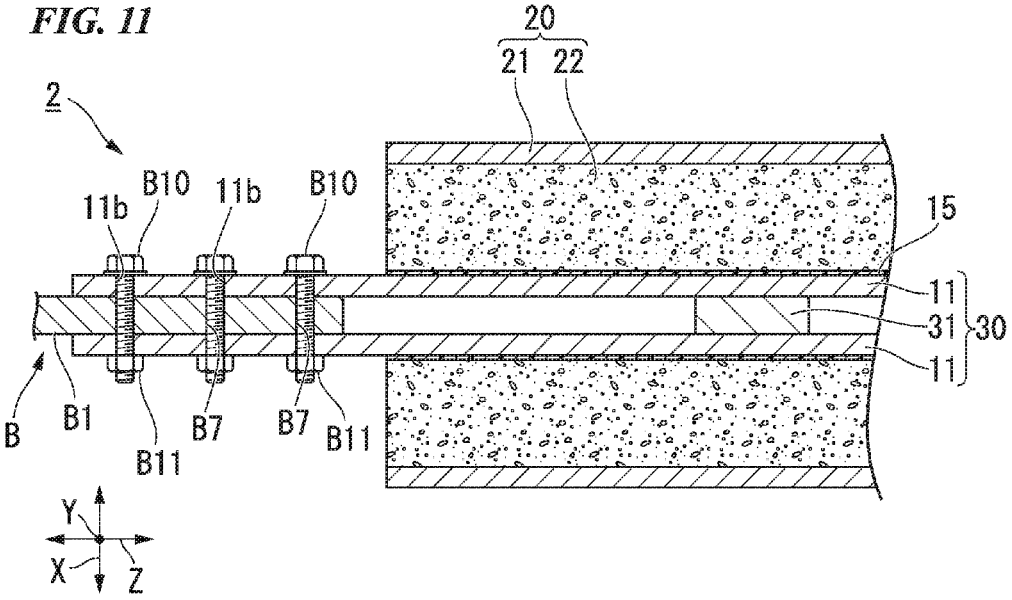
FIG. 11 is a sectional view of the main part taken along cutting-plane line A2-A2 in FIG. 10.

As illustrated in FIGS. 10 and 11, a buckling-restrained brace 2 in the embodiment includes a plate member 30 instead of the plate member 10 of the buckling-restrained brace 1 in the first embodiment. The plate member 30 includes multiple spacing members 31 instead of the core plate 12 of the plate member 10. Only one spacing member 31 is illustrated in FIGS. 10 and 11. The spacing member 31 can be made of a steel plate or the like.

The multiple spacing members 31 are interposed between a pair of the fixing plates 11 while being spaced in the axial direction Z.

The spacing members 31 protrude further than the pair of fixing plates 11 in the perpendicular direction Y. That is, the length of each of the spacing members 31 in the perpendicular direction Y is greater than the length of each of the fixing plates 11 in the perpendicular direction Y.

The welding portion 14 is formed by welding the step between the spacing member 31 and the fixing plate 11.

In the following sequence, the buckling-restrained brace 2 with such a configuration is fixed to the structure B.

The gusset plate B1 of the structure B is interposed between the pair of fixing plates 11. The bolts B10 are inserted into the bolt holes 11*b* of the fixing plates 11, and the through-holes B7 of the gusset plate B1, and are screwed into a nut B11.

As described above, according to the buckling-restrained brace 2 in the embodiment, it is possible to increase the rigidity of the buckling-restrained brace 2, and to easily fix the buckling-restrained brace 2 to the gusset plates B1 of the structure B.

Since the multiple spacing members 31 are used instead of the core plate 12, it is possible to reduce an amount of a material required to manufacture the buckling-restrained brace 2, and to reduce the weight of the buckling-restrained brace 2.

Third Embodiment

Hereinafter, a third embodiment of the present invention will be described with reference to FIGS. 12 to 14. The same reference signs will be assigned to the same portions as in the aforementioned embodiments, and descriptions thereof will be omitted. Only the points of difference will be described.

Figure 12:
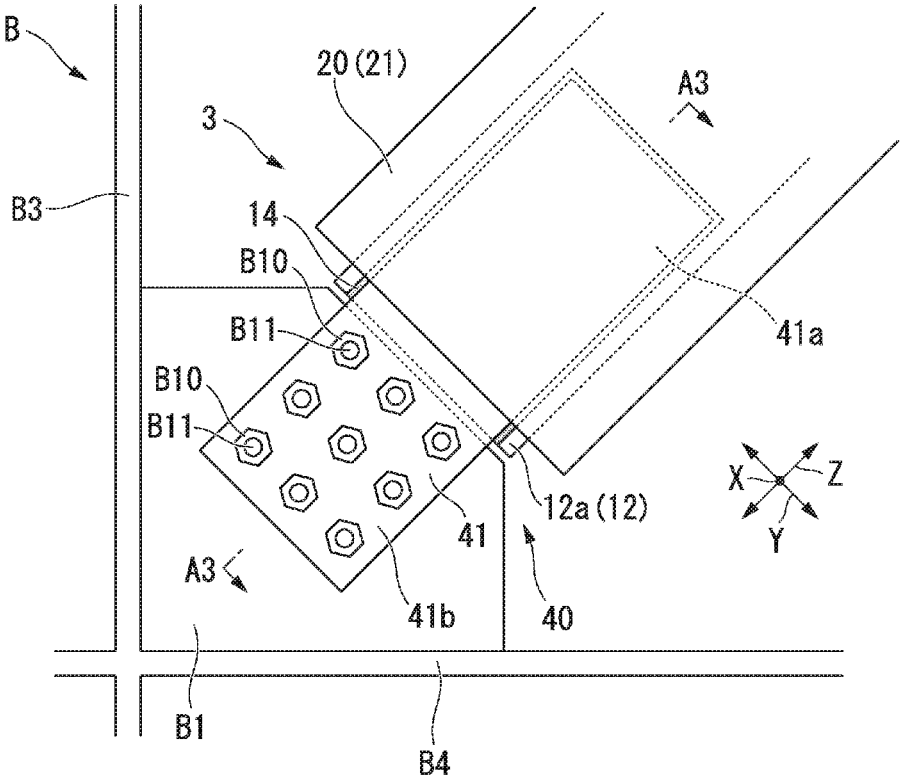
FIG. 12 is a side view of a main part of a buckling-restrained brace in a third embodiment of the present invention.
Figure 13:
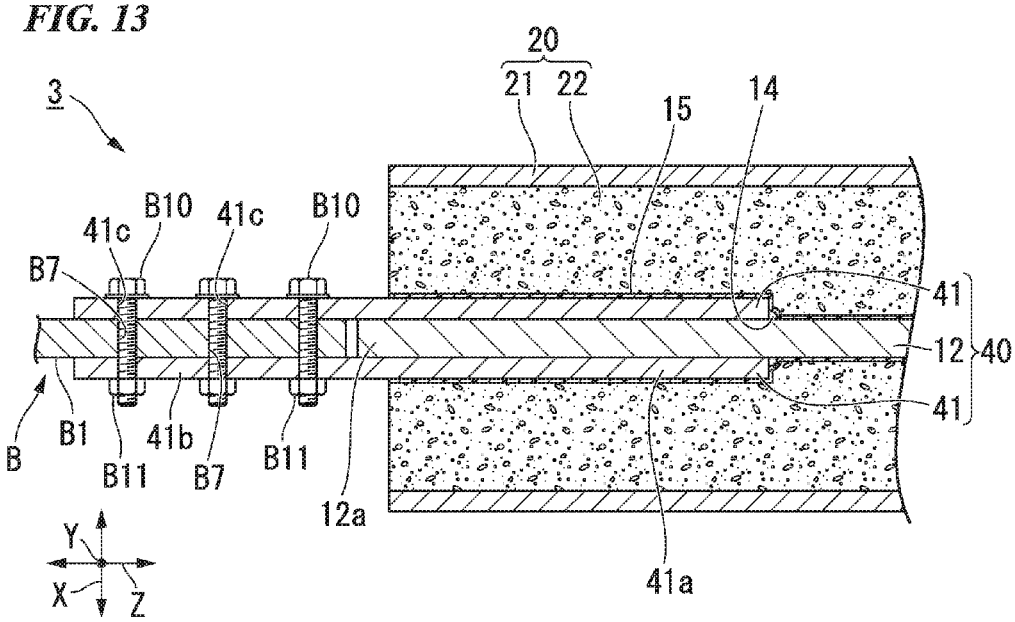
FIG. 13 is a sectional view of the main part taken along cutting-plane line A3-A3 in FIG. 12.

As illustrated in FIGS. 12 and 13, a buckling-restrained brace 3 in the embodiment includes a plate member 40 instead of the plate member 10 of the buckling-restrained brace 1 in the first embodiment.

The plate member 40 includes a pair of fixing plates 41 disposed in each of end portions of the plate member 40 in the axial direction Z, and the core plate 12 fixed to the pair of fixing plates 41. Each of end portions 12*a* of the core plate 12 in the axial direction Z is interposed between the pair of fixing plates 41, and only one of the end portions 12*a* of the core plate 12 is illustrated in FIGS. 12 and 13.

The fixing plates 41 do not extend over the entire length of the core plate 12 (the plate member 40), and are disposed in each of the end portions 12*a* of the core plate 12. One end portion (a portion) 41*a* of the fixing plate 41 in the axial direction Z is embedded in the filler 22, and the other end portion 41*b* protrudes further than the core plate 12 and the pipe member 21 in the axial direction Z. The other end portion 41*b* of the fixing plate 41 is provided with bolt holes 41*c* which penetrate through the fixing plate 41 in the thickness direction X.

The core plate 12 protrudes further than the pair of fixing plates 41 in the perpendicular direction Y. That is, the length of the core plate 12 in the perpendicular direction Y is greater than the length of each of the fixing plates 41 in the perpendicular direction Y.

The welding portion 14 is formed by welding the step between the core plate 12 and the fixing plate 41.

In the following sequence, the buckling-restrained brace 3 with such a configuration is fixed to the structure B.

The gusset plate B1 of the structure B is interposed between the pair of fixing plates 41. The bolts B10 are inserted into the bolt holes 41*c* of the fixing plates 41, and the through-holes B7 of the gusset plate B1, and are screwed into nuts B11.

As described above, according to the buckling-restrained brace 3 in the embodiment, it is possible to increase the rigidity of the buckling-restrained brace 3, and to easily fix the buckling-restrained brace 3 to the gusset plates B1 of the structure B.

In the embodiment, since the fixing plates 41 are disposed only in each of the end portions 12*a* of the core plate 12, it is possible to reduce the size of the fixing plates 41.

Figure 14:
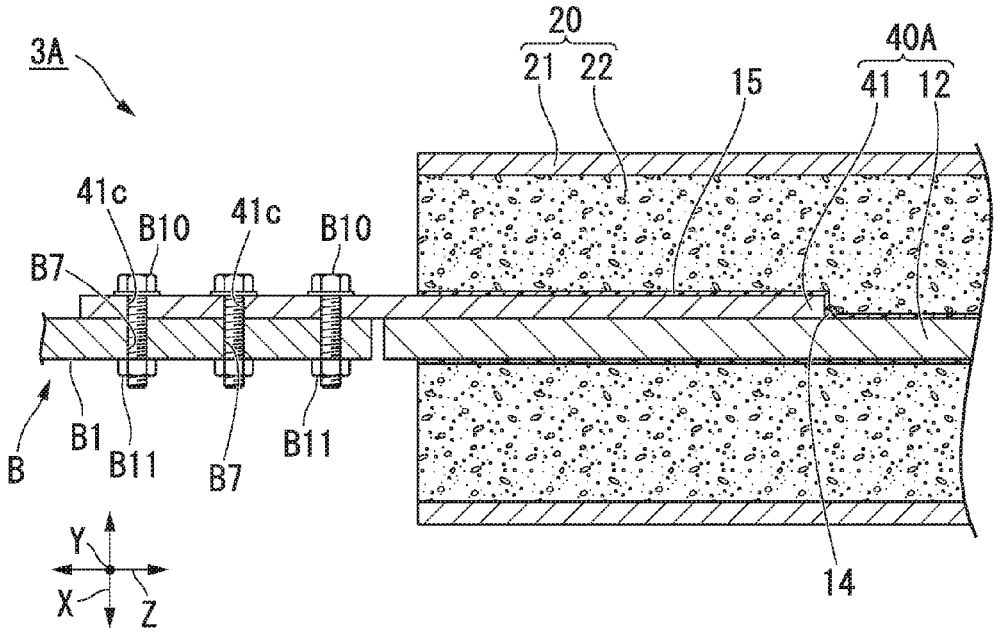
FIG. 14 is a top sectional view of a main part of a buckling-restrained brace in an example in which the number of fixing plates used in an end portion of the buckling-restrained brace in the embodiment of the present invention is changed from two to one.

In the embodiment, as illustrated in the buckling-restrained brace 3A in FIG. 14, a plate member 40A may include one fixing plate 41 that is disposed in each end portion of the plate member 41A in the axial direction Z, and the core plate 12 fixed to a pair of the fixing plates 41.

In this configuration, since one fixing plate 41 to be fixed to the gusset plate B1 is disposed in the end portion of the plate member 40A in the axial direction Z, it is easy to fix the fixing plate 41 to the gusset plate B1.

In this modification example, the plate member may not include the core plate 12, and the plate member may be formed of one fixing plate in which a pair of the fixing plates 41 is integrally formed.

The first to the third embodiments of the present invention have been described with reference to the drawings; however, the specific configuration is not limited to those in the embodiments, and modifications, combinations, or deletions can be made to the configuration insofar as the modifications, the combination, or the deletions do not depart from the purport of the present invention. Naturally, the configurations in the embodiments can be appropriately combined together and used.

For example, the multiple bolt holes are formed in the end portion of the fixing plate in the first to the third embodiments. However, the number of bolt holes formed in the fixing plate is not limited to a specific number, and one bolt hole may be formed in the end portion of the fixing plate.

INDUSTRIAL APPLICABILITY

The structure of the present invention can suitably adopt the buckling-restrained braces disclosed in the embodiments as a countermeasure against earthquakes, wind, or the like.

REFERENCE SIGNS LIST

1, 1A. 2, 3, 3A: BUCKLING-RESTRAINED BRACE
10, 30, 40, 40A: PLATE MEMBER
11, 41: FIXING PLATE
11*a*: END PORTION
11*b*, 41*c*: BOLT HOLE
12: CORE PLATE
12*b*: PORTION
14: WELDING PORTION
20: BUCKLING-RESTRAINED MEMBER
21: PIPE MEMBER
22: FILLER
B: STRUCTURE
B1: GUSSET PLATE (CONNECTED PORTION)
B7: THROUGH-HOLE
B10: BOLT
B11: NUT
S1: DISPOSITION STEP (FIRST STEP)
S3: FILLING STEP (SECOND STEP)
T: PLANE
X: THICKNESS DIRECTION
Y: PERPENDICULAR DIRECTION (INTERSECTION DIRECTION)
Z: AXIAL DIRECTION

What is claimed is:

1. A buckling-restrained brace that is capable of being fixed to connected portions of a structure using bolts, the brace comprising:

a plate member extending in an axial direction, and in which bolt holes for fixing the bolts are formed at end portions of the plate member in the axial direction; and a buckling-restrained member configured to restrain a center portion of the plate member in the axial direction to prevent the plate member from buckling, wherein the buckling-restrained member includes a pipe member surrounding the plate member from the outside in a radial direction, and a filler filling the gap between the pipe member and the plate member, and the plate member includes a pair of fixing plates, a portion of each of the fixing plates is embedded in the filler and the remaining portion is protruded from the filler in the axial direction, the bolt holes are formed at an end portion of the remaining portion in the axial direction, the pair of the fixing plates are placed side by side with each other in a thickness direction of the fixing plates, the length of the pair of the fixing plates is larger than that of the pipe member, end portions of the pair of the fixing plates are respectively protruded from both ends of the pipe member, and the connected portions of the structure are interposed between the pair of the fixing plates at both ends of the plate member in the thickness direction of the fixing plates; wherein the plate member includes a core plate that is fixed to the pair of fixing plates while being interposed between the fixing plates; and wherein the core plate protrudes further than the pair of fixing plates in an intersection direction intersecting the axial direction and the thickness direction, and a portion of the core plate protruding in the intersection direction is fixed to an edge portion of each of the pair of fixing plates in the intersection direction via a welding portion.

2. The buckling-restrained brace to claim 1, wherein the bolt holes are respectively formed in the end portions of the pair of the fixing plates in the axial direction.

3. A method of manufacturing a buckling-restrained brace, the brace is provided with:

a plate member extending in an axial direction, and in which bolt holes for fixing bolts are formed at end portions of the plate member in the axial direction; and a buckling-restrained member configured to restrain a center portion of the plate member in the axial direction to prevent the plate member from buckling, wherein the buckling-restrained member includes a pipe member surrounding the plate member from the outside in a radial direction, and a filler filling a gap between the pipe member and the plate member, and the plate member includes a pair of the fixing plates, a portion of each of the fixing plates is embedded in the filler, and the remaining portion is protruded from the filler in the axial direction, the bolt holes are formed at an end portion of the remaining portion in the axial direction, the pair of the fixing plates are placed side by side with each other in a thickness direction of the fixing plates, the length of the pair of the fixing plates is larger than that of the pipe member, and end portions of the pair of the fixing plates are respectively protruded from both ends of the pipe member, the method comprising:

a first step in which the plate member including the pair of the fixing plates extending in an axial direction of the plate member is inserted to the pipe member so that the pipe member is surrounding the plate member and end portions of the pair of the fixing plates in the axial direction is protruded from the pipe member in the axial direction; and a second step in which the gap between the pipe member and the plate member is filled with the filler, and thereby restraining the center portion of the plate member in the axial direction to prevent the plate member from buckling, wherein a portion of the pair of the fixing plates is embedded in the filler, the remaining portion of the pair of the fixing plates is protruded from the filler in the axial direction, and the bolt holes are formed at an end portion of the remaining portion protruding from the pipe member in the axial direction and are used to fix the buckling-restrained brace to the connected portion of the structure using the bolt; wherein in the first step, the plate member is prepared by fixing the pair of fixing plates and a core plate together via a welding portion, and the plate member is surrounded by the pipe member so that the welding portion is disposed on the inside of the pipe member.

* * * * *